US011712146B2

(12) United States Patent
Ko et al.

(10) Patent No.: US 11,712,146 B2
(45) Date of Patent: Aug. 1, 2023

(54) ROBOT CLEANER

(71) Applicant: LG ELECTRONICS INC., Seoul (KR)

(72) Inventors: Moohyun Ko, Seoul (KR); Sungjun Kim, Seoul (KR); Donggeun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 95 days.

(21) Appl. No.: 16/943,288

(22) Filed: Jul. 30, 2020

(65) Prior Publication Data

US 2021/0030248 A1 Feb. 4, 2021

(30) Foreign Application Priority Data

Jul. 31, 2019 (KR) ..... 10-2019-0093492

(51) Int. Cl.
*A47L 11/40* (2006.01)
*A47L 11/282* (2006.01)

(52) U.S. Cl.
CPC ..... *A47L 11/4083* (2013.01); *A47L 11/282* (2013.01); *A47L 11/4038* (2013.01);
(Continued)

(58) Field of Classification Search
CPC ..... A47L 11/4083; A47L 11/34; A47L 11/0004–0042; A47L 11/408; A47L 2201/00–06; A47L 9/242; B08B 3/00
(Continued)

(56) References Cited

U.S. PATENT DOCUMENTS

2006/0248676 A1 11/2006 Baek
2012/0199006 A1* 8/2012 Swett ..... A47L 9/22 96/417
(Continued)

FOREIGN PATENT DOCUMENTS

CN 101543820 9/2009
CN 106901665 A * 6/2017
(Continued)

OTHER PUBLICATIONS

University of Virginia, Lecture 8 Magnetic Fields Chp. 29, Jul. 14, 2006, Slide 5, <http://galileo.phys.virginia.edu/classes/632.ral5q.summer06/Lecture1-16_Powerpoints/lecture_8_mat/PHYS632_C8_28_Mag_Field.pdf> (Year: 2006).*
(Continued)

*Primary Examiner* — Anne M Kozak
*Assistant Examiner* — Tyler James McFarland
(74) *Attorney, Agent, or Firm* — KED & Associates LLP

(57) ABSTRACT

A robot cleaner includes a water tank forming a space to store water, a body forming an exterior and having a housing which forms a space in which the water tank is mounted, a pair of spin mops rotatably mounted at a lower side of the body, a first nozzle provided at the housing, a second nozzle provided at the tank and configured to couple to the first nozzle, and a fixing part generating a magnetic force when the tank is mounted in the housing to fix an arrangement of the tank mounted in the housing. The fixing part includes a fixing device (e.g., a magnet or metal) provided around a circumference of the second nozzle and a response fixing device (e.g., a magnet or metal) provided around a circumference of the first nozzle and having a shape corresponding to the fixing device. The first nozzle and the second nozzle are attached to each other by the fixing device and the response fixing device.

9 Claims, 16 Drawing Sheets

(52) U.S. Cl.
CPC ..... *A47L 11/4066* (2013.01); *A47L 11/4088* (2013.01); *A47L 11/4061* (2013.01); *A47L 2201/00* (2013.01); *A47L 2201/04* (2013.01)

(58) Field of Classification Search
USPC ..... 15/320
See application file for complete search history.

(56) References Cited

U.S. PATENT DOCUMENTS

| | | | | |
|---|---|---|---|---|
| 2014/0182627 | A1 | 7/2014 | Williams et al. | |
| 2019/0038101 | A1 | 2/2019 | Jang et al. | |
| 2019/0191952 | A1* | 6/2019 | Johnson | A47L 11/4066 |
| 2019/0208970 | A1 | 7/2019 | Suchman et al. | |
| 2019/0290089 | A1 | 9/2019 | Johnson | |
| 2020/0323413 | A1 | 10/2020 | Li | |

FOREIGN PATENT DOCUMENTS

| | | | |
|---|---|---|---|
| CN | 207734102 | | 8/2018 |
| CN | 208081173 | | 11/2018 |
| CN | 208510944 | | 2/2019 |
| KR | 20060115220 | A * | 11/2006 |
| KR | 20070018641 | A * | 2/2007 |
| KR | 10-0704484 | | 4/2007 |
| KR | 10-2008-0016070 | | 2/2008 |
| KR | 10-0836680 | | 6/2008 |
| KR | 10-2008-0100981 | | 11/2008 |
| KR | 10-2009-0102296 | | 9/2009 |
| KR | 10-0946299 | | 3/2010 |
| KR | 10-2010-0076134 | | 7/2010 |
| KR | 20130058495 | A * | 6/2013 |
| KR | 10-1329605 | | 11/2013 |
| KR | 10-2016-0121844 | | 10/2016 |
| KR | 10-2017-0034362 | | 3/2017 |
| KR | 10-2018-0008251 | | 1/2018 |
| KR | 10-2018-0042923 | | 4/2018 |
| KR | 10-2019-0015940 | | 2/2019 |
| RU | 2 344 030 | | 1/2009 |

OTHER PUBLICATIONS

Korean Notice of Allowance dated Sep. 28, 2021 issued in KR Application No. 10-2021-0079321.
International Search Report dated Nov. 13, 2020 issued in Application No. PCT/KR2020/010122.
Korean Office Action dated Sep. 28, 2020 issued in Application No. 10-2019-0093494.
U.S. Appl. No. 16/944,355, filed Jul. 31, 2020.
U.S. Appl. No. 16/944,375, filed Jul. 31, 2020.
U.S. Appl. No. 16/943,288, filed Jul. 30, 2020.
Korean Office Action dated Sep. 22, 2020 issued in Application No. 10-2019-0093491.
Korean Office Action dated Sep. 23, 2020 issued in Application No. 10-2019-0093492.
U.S. Office Action issued in U.S. Appl. No. 16/944,375 dated Oct. 29, 2021.
IRobot. Owner's Guide, https://prod-help-content.care.irobotapi.com/files/i-series/i7/ownersGuide/og-i7-en-GB.pdf 2018 (Year: 2018).
You tube Video—https://youtube.com/watch ?v=W9_Mur3kdrY-iRobot (Year: 2020).
United States Office Action dated Aug. 3, 2022 issued in co-pending related U.S. Appl. No. 16/944,355.
Russian Office Action dated Sep. 20, 2022 issued in RU Application No. 2022104529.
Chinese Office Action dated Sep. 22, 2022 issued in CN Application No. 202080059236.6.

* cited by examiner

ROBOT CLEANER

CROSS-REFERENCE TO RELATED APPLICATION(S)

This application claims priority under 35 U.S.C. § 119 to Korean Application No. 10-2019-0093492, filed in Korea on Jul. 31, 2019, whose entire disclosure(s) is/are hereby incorporated by reference.

BACKGROUND

1. Field

The present disclosure relates to a robot cleaner.

2. Background

Robot cleaners for cleaning the floor or other surfaces to be cleaned (hereinafter, "floors") have recently been developed. Robot cleaners travel across floors to remove foreign materials by suctioning or wiping the foreign materials from the floor surface.

A robot cleaner capable of mopping the floor may move on the surface by rotational friction while rotating about a rotary shaft, which is approximately perpendicular to the floor surface, and by mopping the surface with the rotational friction. A robot cleaner may mop the floor surface with a wet mop. Such a robot cleaner may have a water tank to supply water to spin mops rotating and mopping the floor.

While such a wet mopping robot cleaner may have a stable structure, robot cleaners having a detachable water tank may experience leaking from a connection portion.

Korean Laid-open Patent Publication No. KR10-2019-0015940 discloses a robot cleaner having a detachable water tank without a fixing and a pressing means provided separately for a connection portion, causing leaks.

BRIEF DESCRIPTION OF THE DRAWINGS

Embodiments will be described in detail with reference to the following drawings in which like reference numerals refer to like elements, and wherein.

DETAILED DESCRIPTION

In the description of a robot cleaner and a water tank, a direction in which the water tank is withdrawn may be defined as a rear direction, a direction opposite to the rear direction may be defined as a front direction, a direction in which a spin mop is provided may be defined as a lower direction, and a direction opposite to the lower direction may be defined as an upper direction. Further, a direction of both sides which is perpendicular to the front direction, the rear direction, the upper direction and the lower direction may be defined as a left-right direction. A configuration of the water tank will be described based on the above directions when the water tank is mounted in a housing.

Hereinafter, embodiments of the present disclosure will be described in detail with reference to the accompanying drawings provided for explaining a robot cleaner.

<Overall Configuration>

Figure 1A:
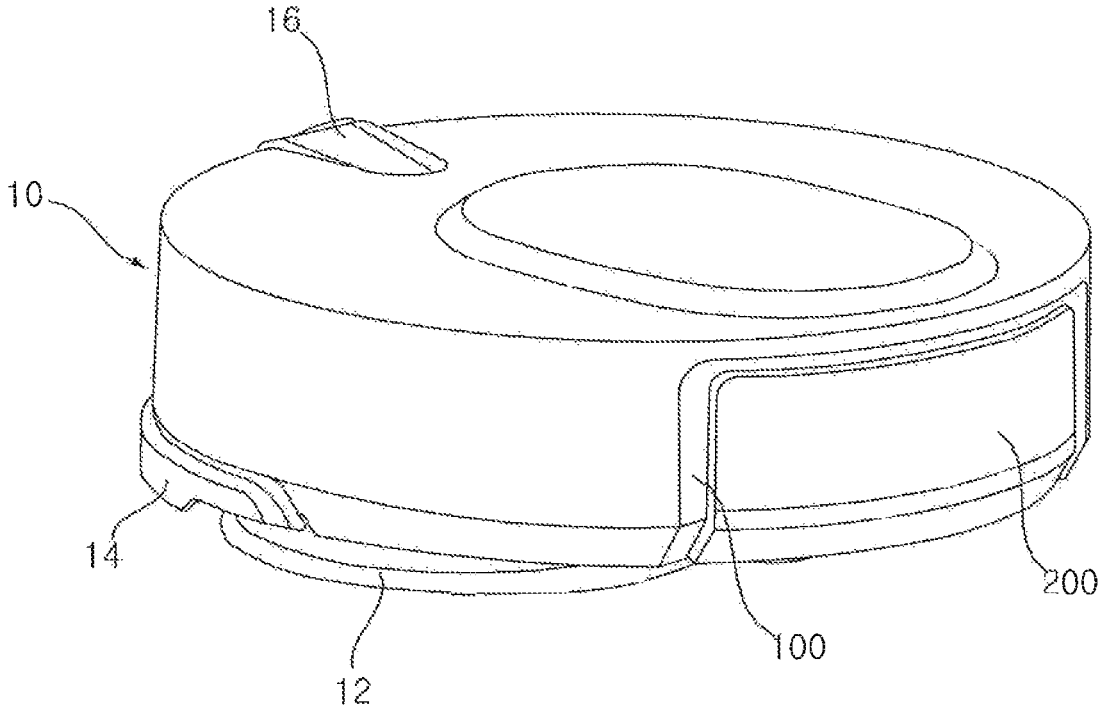
FIG. 1A is a rear perspective view of a robot cleaner according to an embodiment of the present disclosure.
Figure 1B:
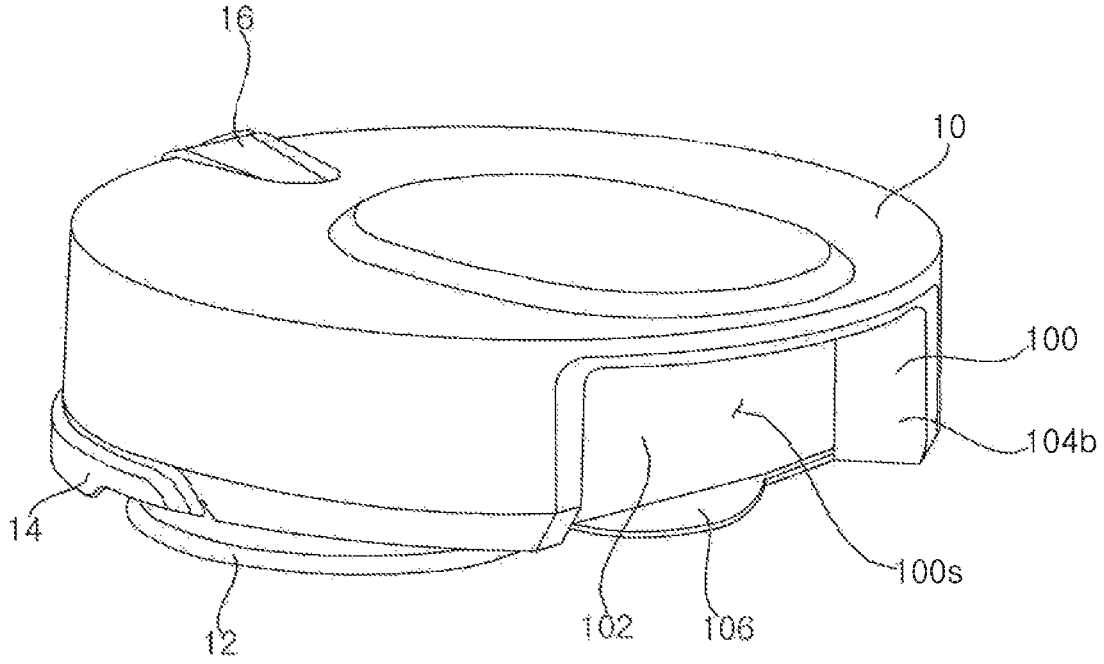
FIG. 1B is a rear perspective view of the robot cleaner of FIG. 1A, from which a water tank is excluded.
Figure 2:
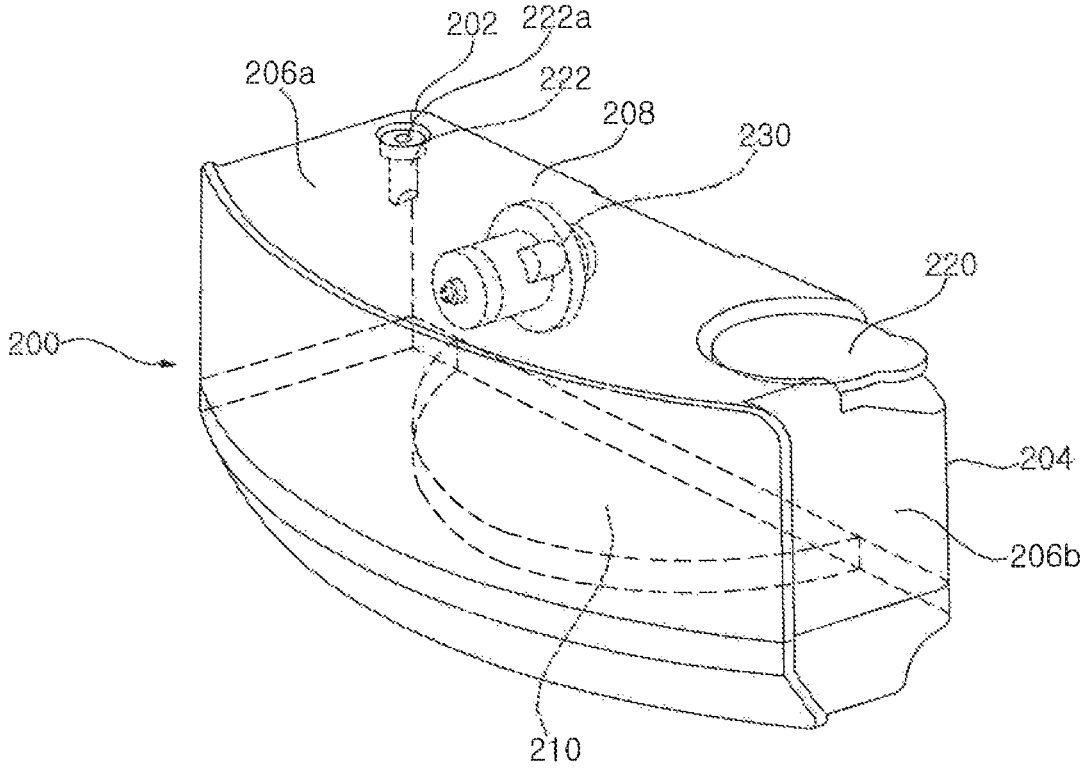
FIG. 2 is perspective view of a water tank according to an embodiment of the present disclosure.

Referring to FIGS. 1 and 2, an overall configuration of a robot cleaner 1 according to an embodiment of the present disclosure will be described below. The robot cleaner 1 may include a body 10 forming an exterior of the robot cleaner 1 and having an internal space, at least one (e.g., two) spin mops 12 provided at a lower side of the body 10, a water tank 200 mounted at the body 10 to store water or liquid to be supplied to the pair of spin mops 12, and a water supplier or assembly provided inside of the body 10 to supply the water stored in the water tank 200 to each of the pair of spin mops 12. The spin mops 12 may not only mop a surface to be cleaned (e.g., a floor surface), but also move the body 10 while rotating. Although the drawings show a pair of spin mops 12, embodiments disclosed herein are not limited.

The robot cleaner 1 may further include a bumper 14 mounted at the front of the body 10 to absorb any shock caused by coming in contact with obstacles on the floor surface. A sensor 16 may sense a position of the body 10 and detect obstacles.

The body 10 may have a flat disc shape. In the internal space of the body 10, a printed circuit board (PBC) may be provided, which includes a controller to adjust a rotation speed of the pair of spin mops 12 or to adjust an amount of water to be supplied from the water tank 200 to the pair of spin mops 12 by controlling the water supplier. In the internal space of the body 10, external power may be supplied to charge a battery, and charged power from the battery (or alternatively, directly from a commercial external power supply via a cable) may be provided to the printed circuit board or to a motor that rotates the pair of spin mops 12.

The water supplier may include a first nozzle 110 connected to the water tank 200 mounted at the body 10, a supply pipe or channel to connect the first nozzle 110 and each of the spin mops 12, and a pump provided at the supply pipe to suction water stored in the water tank 200 to deliver the water to the spin mops 12.

<Housing>

Hereinafter, a housing according to an embodiment of the present disclosure will be described with reference to FIG. 1B and FIGS. 5 to 7.

The body 10 may include a housing or dock 100 provided at the rear of the body 10 and forming a mounting space 100*s* for the water tank 200. The housing 100 may be integrally formed with the body 10. Alternatively, the housing 100 may be provided separately from the body 10 and later combined. The mounting space 100*s* may have a shape or inner contour corresponding to an outer shape or contour of the water tank 200 so that the water tank 200 may be mounted and/or fitted in the mounting space 100*s*.

The housing 100 may be a recessed portion of the body 10 configured to receive the water tank 200. The housing 100 may include a front or recessed wall 102, side walls 104*a* and 104*b*, an upper wall, and a lower wall 106. The front wall 102 may come into contact with or being provided closest to the water tank 200 when the water tank 200 is mounted in the housing 100. The two side walls 104*a* and 104*b* may be formed to face side surfaces of the water tank 200 and may be configured to guide the water tank 200 when the water tank 200 is inserted into or withdrawn from the housing 100. The upper wall may face an upper surface of the water tank 200 when the water tank 200 is mounted in the housing 100. The lower wall 106 may support the water tank 200 when the water tank 200 is mounted in the housing 100. The housing 100 may have an open rear surface for the water tank 200 to be inserted into or withdrawn from the housing 100. The front wall 102, the side walls 104*a* and 104*b*, the upper wall, and the lower wall 106 may form the mounting space 100*s* for the water tank 200 to be mounted therein.

When the water tank 200 is mounted in the housing 100, the water tank 200 may contact the front wall 102, or alternatively be very close to the front wall 102. The water tank 200 may include a second nozzle 230 configured to connect to the first nozzle 110 of the housing 100 when the water tank 200 is mounted. The first nozzle 110 may be provided at the front of the front wall 102 of the housing 100, and the second nozzle 230 may be positioned so as to align with the first nozzle 110 upon mounting of the water tank 200. The second nozzle 230 and a connection to the first nozzle 110 will be described later.

The first nozzle 110 may include an insertion portion or protrusion 112 forming an insertion space 112*s* for the second nozzle 230, a connector 120 having a hollow inner space and extending or protruding forward from a center of the insertion portion 112, a press 122 having a hollow inner space and extending rearward from a center of the insertion portion 112 toward the water tank 200 (FIG. 6), and a sealer or seal 130 provided at the insertion space 112*s* and pressed against the inserted second nozzle 230.

The insertion portion 112 may protrude forward from the front wall 102. The insertion portion 112 may have an inner circumferential wall 114 defining the insertion space 112*s*, which may have a cylindrical or annular shape inside the insertion portion 112. An end wall 116 may be provided on an end portion of the circumferential wall 114.

The press 122 may be provided inside the insertion space 112*s* (e.g., at a middle or center position). The sealer 130 may be provided in the insertion space 112*s* between the press 122 and the inner circumferential surface and, when the second nozzle 230 is inserted, pressed against the second nozzle 230, thereby preventing water supplied from the second nozzle 230 from leaking to an outside of the robot cleaner 1.

Figure 3:
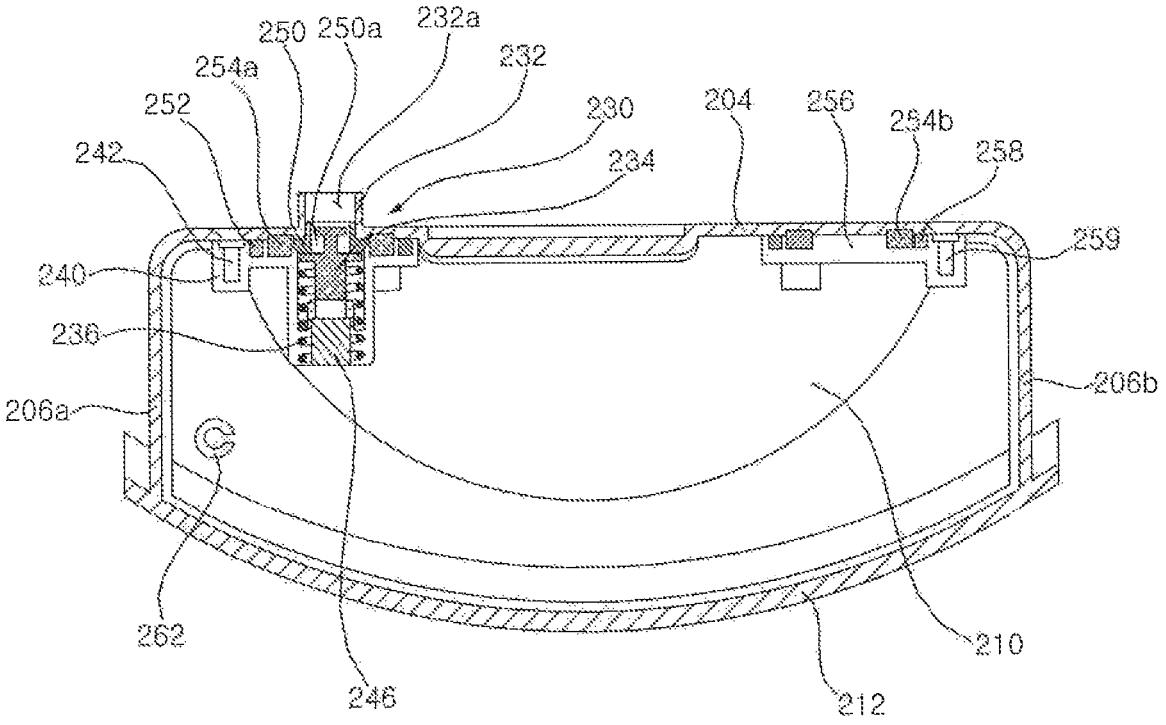
FIG. 3 is a cross-sectional view of a water tank, taken in a left-right direction according to an embodiment of the present disclosure.

The sealer 130 may be provided along or around an outer circumferential surface of the press 122. The sealer 130 may include an end or front contact surface 132 (FIG. 5) provided at the end wall 116 to come into contact with an end portion of an insertion projection or nozzle 232 (see also FIGS. 3-4) of the second nozzle 230, a sealer circumference or press contact surface 134 connected to the sealer end 132 and extending along or around the outer circumferential surface of the press 122, and at least one sealer projection or fin 136*a* and/or 136*b* protruding outward from the sealer circumference 134 in the insertion space 112*s*.

The sealer projections 136*a* and 136*b* protrude from the sealer circumference 134 toward the end wall 116 in a hopper or slanted shape. The sealer projections 136*a* and 136*b* may include a first sealer projection 136*a* provided at the end portion of the sealer circumference 134 and a second sealer projection 136*b* interposed between the first sealer projection 136*a* and the sealer end 132.

The connector 120 may protrude forward from the end wall 116 and may be connected to the supply pipe provided inside the body 10. The press 122 may protrude rearward from the end wall 116 and press against one side of a valve 234 when the water tank 200 is mounted in the housing 100. The press 122 and the connector 120 are provided in a front-rear direction and have hollow inner portions or spaces which communicate with each other.

The press 122 may protrude rearward of the front wall 102. A projection or rib 124 may project or protrude rearward at an end portion of the press 122 toward the second nozzle 230. A plurality of projections 124 may be spaced apart from each other along the end portion of the press 122. Accordingly, even when the press 122 is in contact with the valve 234, the press 122 may not be blocked.

Response fixing devices 140*a* and 140*b* may be provided to fix an arrangement of the water tank 200 when mounted in the housing 100. A first response fixing device 140*a* may be formed in a ring shape at a first (e.g., left) side of the front wall 102 to be provided around an outer circumference of the insertion portion 112, while a second response fixing device 140*b* may be provided at a second (e.g., right) side of the front wall 102 in a ring shape. The second response fixing device 140*b* may be provided at a position corresponding to a second fixing device described later. The response fixing devices 140*a* and 140*b* may be magnetic (e.g., a permanent magnet or a ferromagnetic metal) to generate or exert a magnetic force. A rare earth magnet having a strong magnetic force may be used as the response fixing devices 140*a* and 140*b*. More details of the first nozzle 110 and the second nozzle 230 will be described later.

Figure 7:
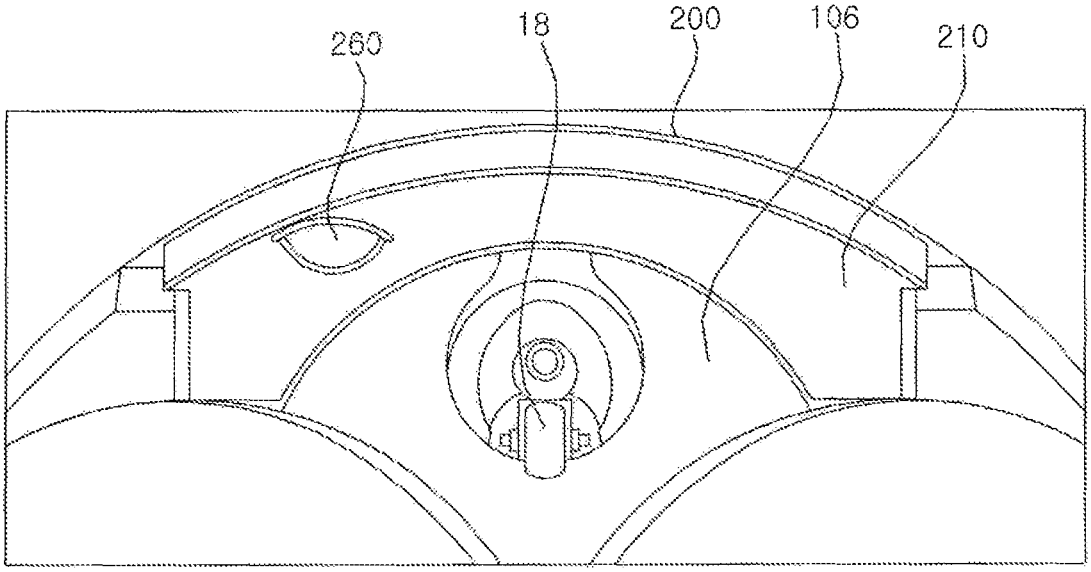
FIG. 7 is a bottom view of a water tank mounted in a housing, according to an embodiment of the present disclosure.

Referring to FIG. 7, an auxiliary wheel 18 may support a rear portion of the body 10. The auxiliary wheel 18 may be provided below the lower wall 106 of the housing 100.

<Water Tank>

Hereinafter, the water tank 200 according to an embodiment of the present disclosure will be described with reference to FIGS. 2 to 7.

The water tank 200 may include a casing 202 forming a space to store water, an opening cover or cap to open or close an opening formed at an upper side of the casing 202, the second nozzle 230 configured to connect to the first nozzle 110, and fixing devices 254*a* and 254*b* to maintain a mounting of the water tank 200 in the housing 100. A first fixing device 254*a* may correspond to and align with the first response fixing device 140*a*, and a second fixing device 254*b* may correspond to and align with the second response fixing device 140*b*.

The casing 202 may have a shape corresponding to the mounting space 100*s* formed by the housing 100. Accordingly, the casing 202 may be inserted into or withdrawn from the mounting space 100*s* formed by the housing 100.

The casing 202 may include a front case or wall 204 configured to face the front wall 102 of the housing 100], side cases or walls 206 configured to face the side walls 104*a* and 104*b* of the housing 100, an upper case or wall 208 configured to face the upper wall of the housing 100, a lower case or wall 210 configured to face the lower wall 106 of the housing 100, and a rear case or wall 212 provided at the rear side and exposed to an outside.

An opening may be formed at the upper side of the casing 202 to supply water into the inside of the casing 202. An opening cover or cap 220 may open or close the opening. The cover 220 cover 220 may be provided at the upper case 208 where the opening is formed.

An air passage 222*a* for communicating the inside and outside of the water tank 200 is formed at the upper case 202. The air passage 222*a* may be formed at a separate passage member 222 mounted at the upper side of the casing 202. The passage member 222 having the air passage 222*a* may be provided at the upper case 208.

The air passage 222*a* may be formed at the upper case 208. The upper case 208 may be spaced apart from the upper wall of the housing 100 by a predetermined distance when the water tank 200 is mounted in the housing 100. Accordingly, even when water in the water tank 200 is discharged through the second nozzle 230 while the water tank 200 is mounted, external air may be drawn into the water tank 200 through the air passage 222*a*.

The second nozzle 230 may be provided at the front case 204. The second nozzle 230 may be biased to the left side or to the right side of the front case 204. The second nozzle 230 according to an embodiment of the present disclosure is biased to the left side of the front case 204. A connection hose fixing device 262, which will be described below, may be biased to the same size of the second nozzle 230 (i.e., the left side) on the lower case 210 such that a length of the connection hose extending between the second nozzle 230 and the connection hose fixing device 262 may be minimized.

The second nozzle 230 may include the insertion nozzle 232 inserted into the insertion space 112*s*, an opening or discharge port 232*a*, which is open to the front side, provided at a front of the insertion nozzle 232, a valve or discharge valve 234 provided behind the insertion nozzle 232 to open or close the opening 232*a* by moving forwards and backwards, an elastic member or spring 236 applying an elastic force to the valve 234 in one direction (e.g., a forward direction), and a nozzle housing 240 mounted into the casing 202 and forming a space to mount the valve 234.

The insertion nozzle 232 may have a cylindrical shape and protrude forward from the front case 204. The insertion nozzle 232 may be inserted into the insertion space 112*s* when the water tank 200 is mounted to be provided between the press 122 and the circumferential wall 114 and be pressed against the sealer 130.

The valve 234 may be provided in an inner space formed by the nozzle housing 240 to move forwards and backwards. The valve 234 may include a first plate 234*a* pressed against the press 122 when the water tank 200 is mounted, a second plate 234*b* spaced apart rearward from the first plate 234*a* and coming into contact with an inner sealer 250 to restrict forward movement of the valve 234, and at least one guide projection or protrusion 234*c* projecting rearward from the second plate 234*b* and moving along a guider or guide 246 formed at the nozzle housing 240.

A diameter 234*a*D of the first plate 234*a* may be smaller than a diameter 234*b*D of the second plate 234*b*. The first plate 234*a* may be spaced apart forward from the second plate 234*b*. The diameter 234*a*D of the first plate 234*a* may be smaller than a diameter 250D of an inner circumferential surface of the inner sealer 250. The diameter 234*b*D of the second plate 234*b* is greater than the diameter 250D of the inner circumferential surface of the inner sealer 250. The second plate 234*b* may come into contact with the elastic member 236. Accordingly, when a force is not applied separately to the valve 234 to compress the elastic member 236, the valve 234 may move forward by a restoring force of the elastic member 236. When a force is not applied separately to the valve 234, the valve 234 comes into contact with the inner sealer 250 by the elastic force of the elastic member 236.

Figure 4:
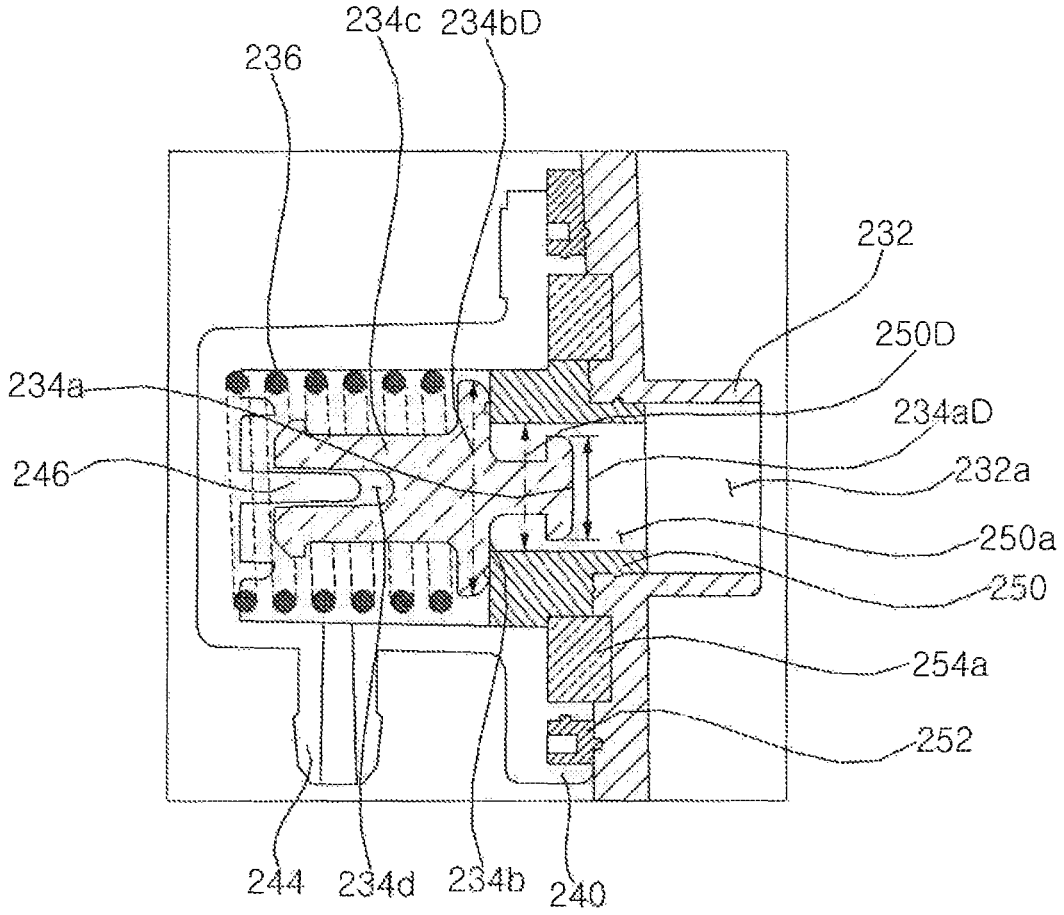
FIG. 4 is a cross-sectional view of a second or discharge nozzle of a water tank, taken in an up-down direction according to an embodiment of the present disclosure.
Figure 5:
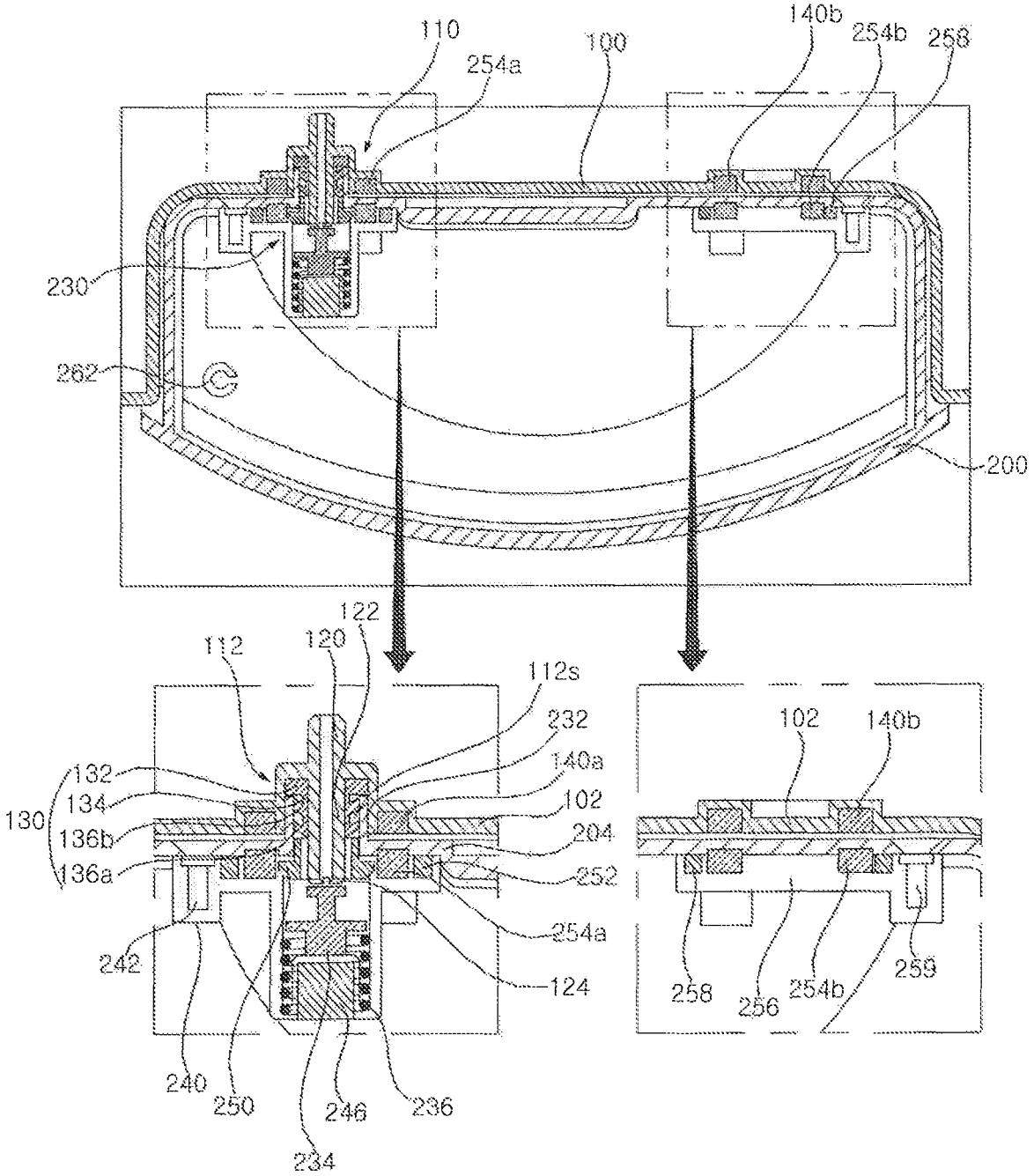
FIG. 5 is a cross-sectional view of a water tank mounted in a housing, taken in a left-right direction according to an embodiment of the present disclosure.
Figure 6:
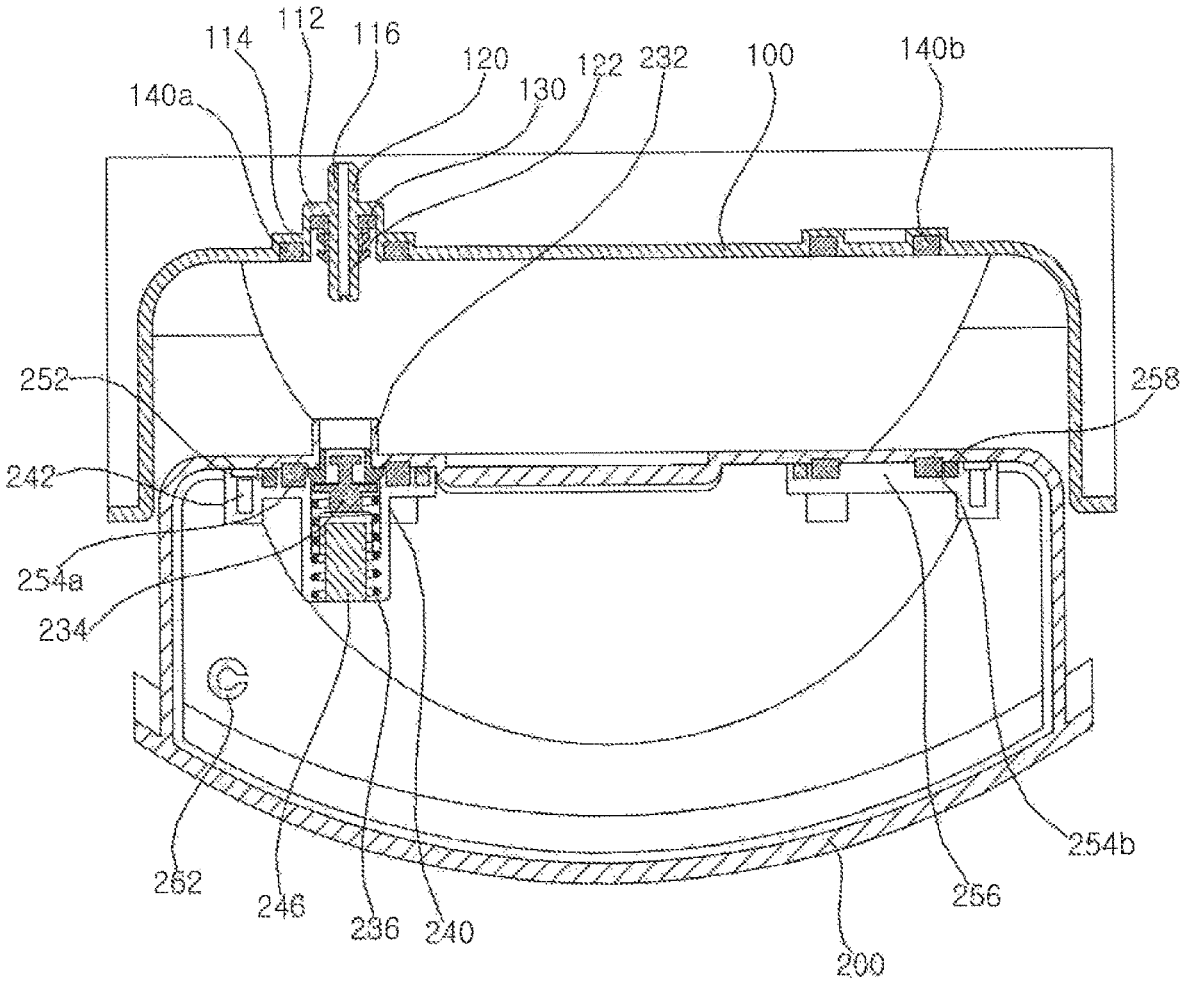
FIG. 6 is a cross-sectional view of a water tank which is moved backward from a mounting space of a housing, taken in a left-right direction according to an embodiment of the present disclosure.

The guide projection 234*c* projects rearward from the second plate 234*b*. Referring to FIG. 4, the valve 234 includes a pair of guide projections 234*c* in an up-down direction. A guide groove 234*d*, in which the guider 246 is provided, may be formed between the pair of guide projections 234*c*.

The nozzle housing 240 may be mounted into the inside of the casing 202. The nozzle housing 240 may be fixed to the inside of the casing 202 via a separate coupling member 242 (e.g., a bolt or screw).

Referring to FIG. 4, the nozzle housing 240 may have an inner nozzle 244 protruding to the inner space of the water tank 200. The inner nozzle 244 may protrude downward from the nozzle housing 240. A separate connection hose extending to the lower case 210 may be connected to the inner nozzle 244. The connection hose fixing device 262 for fixing the other end of the connection hose may be provided at the lower case 210.

The nozzle housing 240 may include the guider 246, protruding forward from a rear surface of the nozzle housing 240 and guiding the movement of the valve 234. The guider 246 may be provided into the guide groove 234*d* formed at the valve 234. As the guider 246 is inserted into the guide groove 234*d*, the valve 234 may move forward and backward.

A plurality of sealers or gaskets 250, 252 are provided between the nozzle housing 240 and an inner surface of the water tank 200. The plurality of sealers 250, 252 may include an inner sealer or gasket 250 and an outer sealer or gasket 252 provided between the nozzle housing 240 and the inner surface of the water tank 200. The inner sealer 250 may be provided at a portion where the opening 232*a* is formed, and the outer sealer 252 may be provided on an outer circumferential surface of the nozzle housing 240.

The inner sealer 250 may be provided at the casing 202 having the opening 232*a* and restrict the movement of the valve 234 moving forward and backward. When the water tank 200 is not mounted in the housing 100, the valve 234 is pressed against the inner sealer 250. The inner sealer 250 may have a ring shape. The inner sealer 250 may have a sealer opening 250*a* formed at the center thereof and communicating with the opening 232*a*.

The outer sealer 252 may have a greater radius than the inner sealer 250 and spaced apart from the inner sealer 252 in a radial direction. The outer sealer 252 may have an annular shape. The fixing devices 254*a* and 254*b* may be interposed between the inner sealer 250 and the outer sealer 252. Accordingly, the inner sealer 250 and the outer sealer 252 may prevent water from flowing into the fixing devices 254*a* and 254*b* provided between the internal and outer sealers 250 and 252.

The fixing devices 254*a* and 254*b* may generate a magnetic force (and/or be made of a magnetic material) to correspond to the response fixing devices 140*a* and 140*b*. The fixing devices 254*a* and 254*b* may be provided between the nozzle housing 240 and the inner surface of the water tank 200 and between the outer sealer 252 and the inner sealer 250.

The fixing devices 254*a* and 254*b* may be provided at the front case 204. When the water tank 200 is mounted in the housing 100, the fixing devices 254*a* and 254*b* may be provided adjacent to the response fixing devices 140*a* and 140*b*.

As the fixing devices 254*a* and 254*b*, a permanent magnet generating a magnetic force may be used. Further, a rare earth magnet having a strong magnetic force may also be used as the fixing devices 254*a* and 254*b*.

The fixing devices 254*a* and 254*b* may include the first fixing device 254*a* provided at the second nozzle 230. The first fixing device 254*a* and the second fixing device 254*b* may be spaced apart from each other in a left-right direction with respect to the center of the water tank 200, and the second fixing device 254*b* may be positioned so as to be bilaterally symmetrical to the first fixing device 254*a*.

Embodiments disclosed herein are not limited to two rare earth magnets implemented as the fixing devices 254*a* and 254*b* and the response fixing devices 140*a* and 140*b*. A magnetic coupling between the fixing devices 254*a* and 254*b* and the response fixing devices 140*a* and 140*b* may not necessarily need to include two sets of magnets having opposite polarities, and may alternatively include metals configured to be attracted to a ferromagnetic metal or magnet.

A second fixing device housing 256 may be provided to fix the second fixing device 254*b* to the inside of the water tank 200 A sealer 258 may prevent water from flowing into the inside of the second fixing device housing 256 and/or between the water tank 200 and the housing 100 and may be provided between the second fixing device housing 256 and the water tank 200.

The second fixing device 254*b* may have the same ring shape as the first fixing device 254*a*. The sealer 258 may have a ring shape to surround a circumferential surface of the second fixing device 254*b*. The second fixing device housing 256 may be coupled to the inside of the water tank 200 via a separate coupling member 259.

The water tank 200 may have a handle 260 (FIG. 7) with a shape that allows a user to easily hold the water tank 200 when withdrawing the water tank 200 from the housing 100. Referring to FIG. 7, the handle 260 may be provided at one side of the casing 202 at the lower case 210 and have a groove so that the user's hand may hold the handle 260.

Second Embodiment

Referring to FIGS. 8 to 12, a configuration of a water tank 200, and a housing 100 in which the water tank 200 is mounted, will be described below.

The overall configuration of the water tank 200 and the housing 100 illustrated in FIGS. 8 to 12 is broadly the same as that described above with reference to FIGS. 1 to 7. Accordingly, the water tank 200 and the housing 100 illustrated in FIGS. 8 to 12 will be described below based on configurations different from the water tank 200 and the housing 100 described above with reference to FIGS. 1 to 7.

Figure 8:
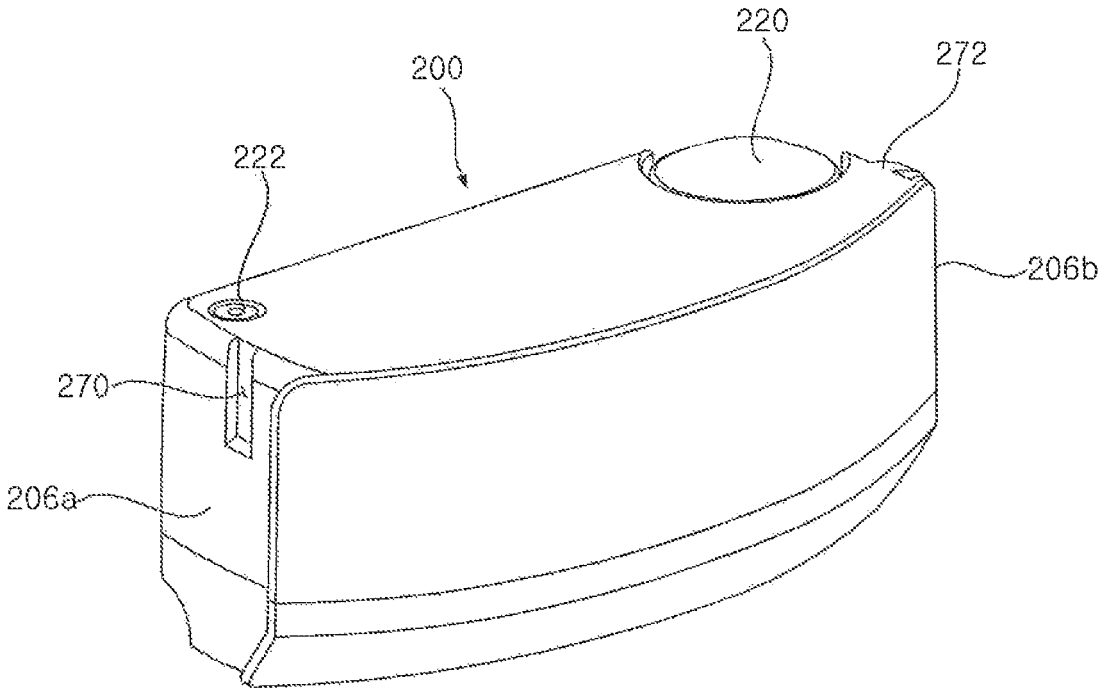
FIG. 8 is a rear perspective view of a water tank according to another embodiment of the present disclosure.
Figure 9:
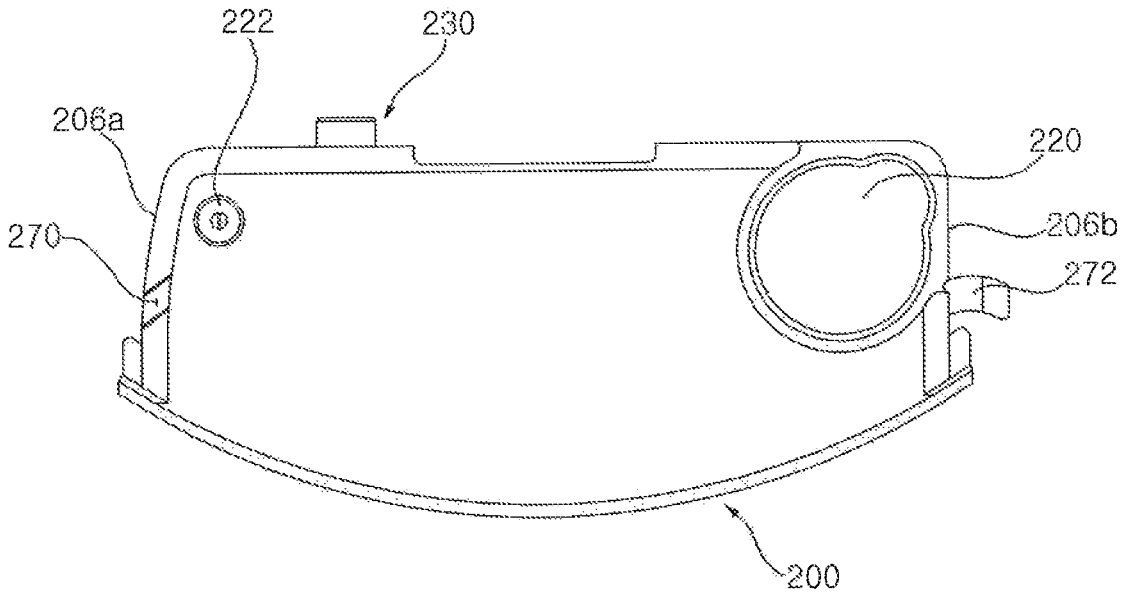
FIG. 9 is a plan view of a water tank according to another embodiment of the present disclosure.

Referring to FIGS. 8 and 9, the water tank 200 may have a lever groove 270 into which a lever 310 (FIG. 10) to be described later is inserted. The side cases 206 may include a first or left side case 206*a* and a second or right case 206*b*. The lever groove 270 may be provided at the first side case 206*a*. The water tank 200 may have a hinge 272 protruding from the second side case 206*b*. The hinge 272 may protrude forward from the second side case 206*b* in a convex curved shape.

Figure 12:
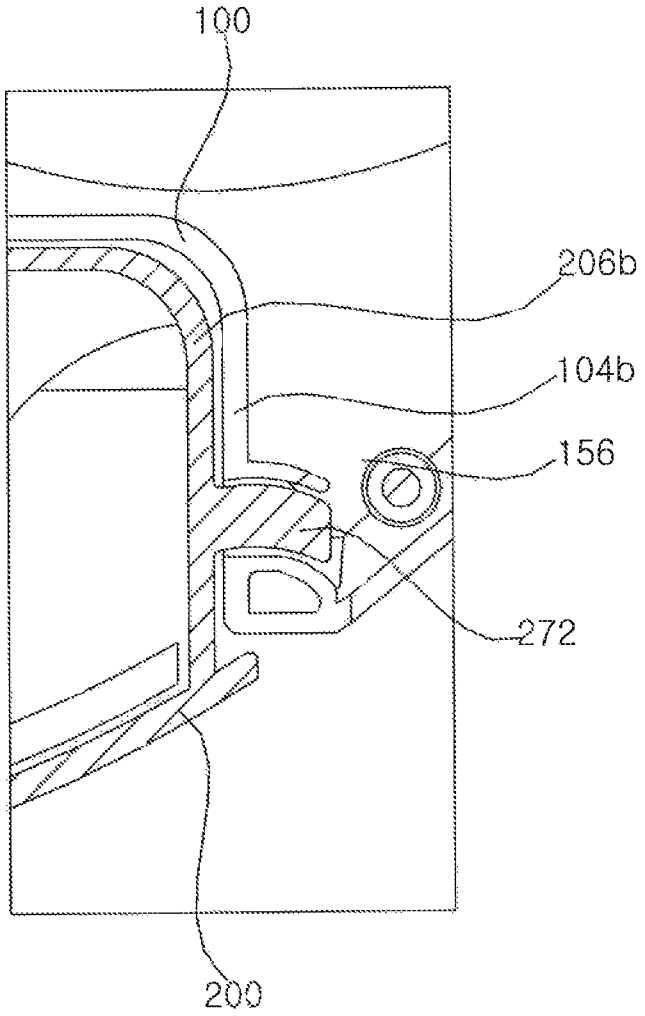
FIG. 12 is a diagram explaining a connective relationship between a hinge of a water tank and a hinge groove of a housing, according to another embodiment of the present disclosure.

The housing 100 may have a second lever hole 154 (FIG. 10) through which a second lever 314 described later passes. The side walls 104*a* and 104*b* may include a first or left side wall 104*a* and a second or right side wall 104*b* (FIGS. 1B and 12). The second lever hole 154 may be formed on the first side wall 104*a* at a position corresponding to the lever groove 270 of the water tank 200. When the water tank 200 is mounted in the housing 100, the second lever 314 passes through the second lever hole 154 to be inserted into the lever groove 270 of the water tank 200.

Figure 10:
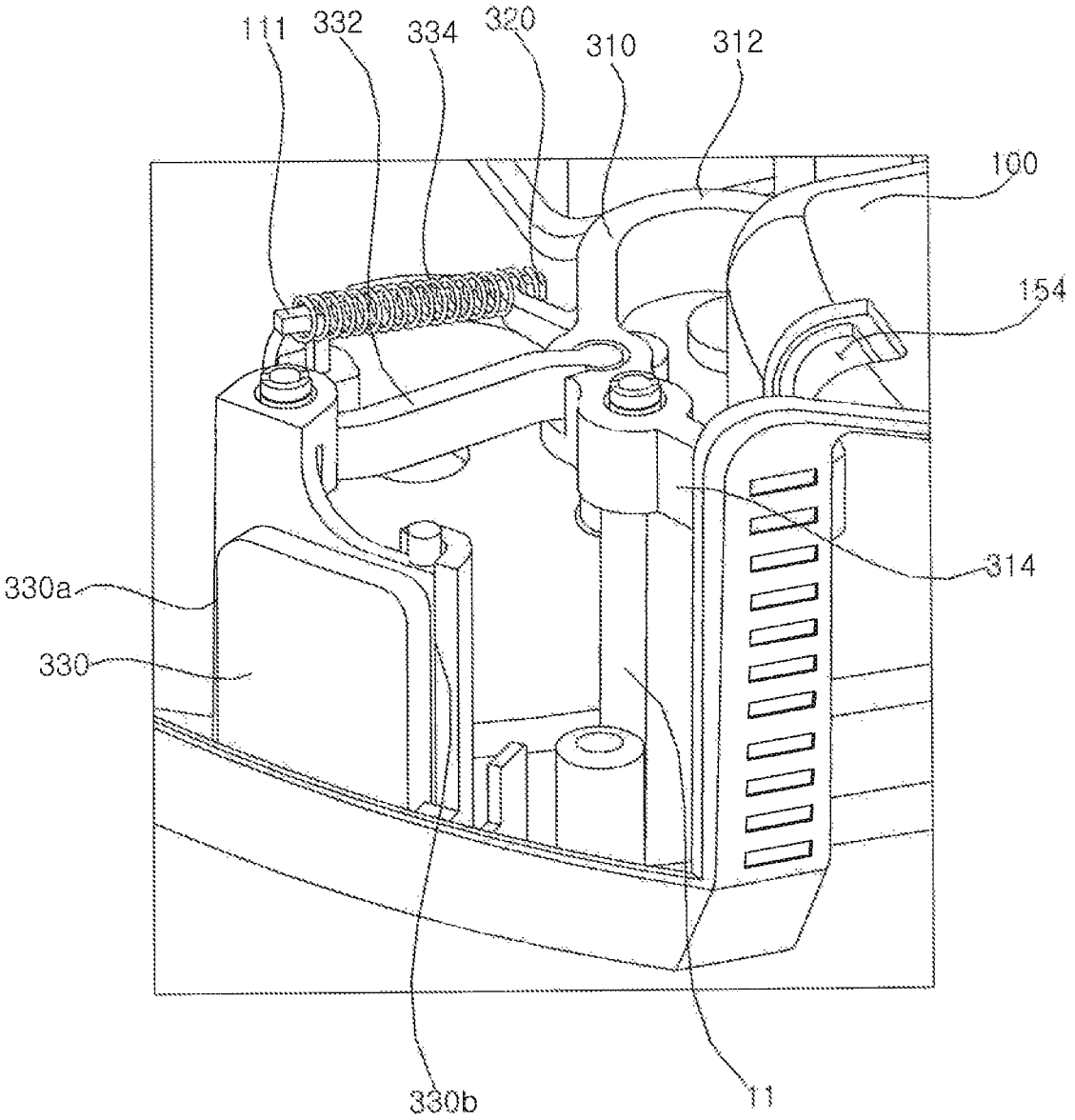
FIG. 10 is a diagram explaining a lock disposed inside a body of a robot cleaner according to another embodiment of the present disclosure.
Figure 11A:
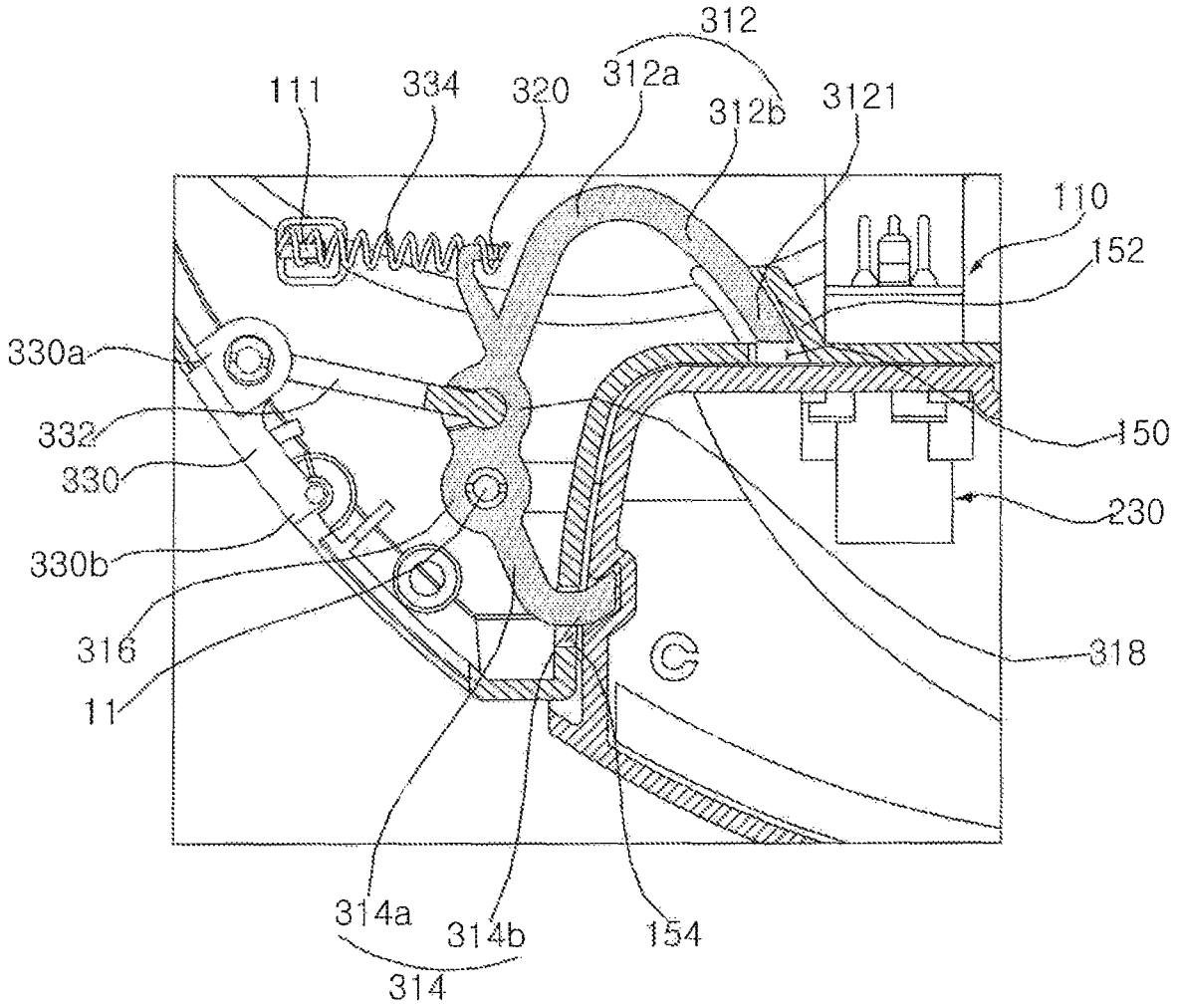
FIG. 11A is a diagram explaining a state in which a water tank is mounted in a housing by a lock, according to another embodiment of the present disclosure.

Referring to FIGS. 10-12, the housing 100 may have a first lever hole 150 (FIG. 11A) through which a first lever 312 described below passes. The first lever hole 150 may be formed in the front wall 102 of the housing 100. The housing 100 may have a lever guider or guide 152 protruding forward from one side of the first lever hole 150 and guiding the movement of the first lever 312. The first lever 312 may be inserted into the lever guider 152 to move. At least a portion of the first lever 312 may be supported by the lever guider 152, thereby reducing a likelihood that the first lever 312 will be damaged when the water tank 200 is pushed rearwards.

The housing 100 may have a hinge groove 156 (FIG. 12) into which the hinge 272 of the water tank 200 is inserted. The hinge groove 156 may be formed at the second side wall 104*b*. The hinge groove 156 may have a shape corresponding to the hinge 272. Accordingly, even when one side of the water tank 200 protrudes rearwards by the first lever 312, the hinge 272 and the hinge groove 156 may not interfere with the movement of the water tank 200.

A robot cleaner 1 according to an embodiment of the present disclosure may include a lock 300. When the water tank 200 is mounted in the housing 100, the lock 300 may fix the water tank 200 to the housing 100 or release the water tank 200 from the housing 100. The lock 300 may be rotatably mounted on the inside of the body 10 such that, depending on the arrangement, the lock 300 may fix the arrangement of the water tank 200, or may move the water tank 200 to the rear side.

The lock 300 may rotate about a rotary shaft formed on an outer side of the first side wall 104*a*. The lock 300 may include a lever 310 and a button 330. The lever 310 may be inserted into the lever groove 270 of the water tank 200 or press the front case 204 of the water tank 200. The button 330 may be provided on the circumferential surface of the body 10 and connected to the lever 310. Here, the connection of the button 330 and the lever 310 may be implemented as a direct connection of the button 330 and the lever 310 or alternatively an indirect connection via another member. The lock 300 may include a press bar 332 to transmit a force exerted on the button 330 to the lever 310. The button 330 may transmit an external force to the lever 310 to rotate the lever 310.

The lock 300 may include an elastic member or spring 334 to maintain a basic or initial arrangement of the lever 310. Here, the basic arrangement of the lever 310 refers to a state in which pressure is not transmitted from the button 330 to the lever 310. In the basic arrangement of the lock 300, the second lever 314 is provided to pass through the second lever hole 154. In the basic arrangement of the lock 300, the first lever 312 is provided to pass through the first lever hole 150 so as not to protrude rearward of the housing 100.

The lever 310 may be provided rotatably about the rotary shaft formed on the inside of the body 10. In addition to the first lever 312 and the second lever 314, the lever 310 may include a rotation part or joint 316 rotatably coupled to the body 10, and a press bar connector or joint 318 coupled to the press bar 332 The rotation part 316 may alternatively be referred to as a fulcrum. The first lever 312 may protrude forward from the rotation part 316 and be bent toward the front wall 102 of the housing 100. The second lever 314 may protrude rearward from the rotation part 316 and be bent toward the first side wall 104*a* of the housing 100.

The lever 310 may rotate about the rotation part 316, which may be spaced apart from an outer side of the circumferential surface of the housing 100. When rotating in a first direction, the lever 310 may be inserted into the lever groove 270 formed at a side case 206*a* of the water tank 200 to maintain a position of the water tank 200. When rotating in an opposite direction to the first direction, the lever 310 may press the front surface of the water tank 200 to release the water tank 200 from the housing 100.

The rotation part 316 may have a an axial projection or a shaft protrusion 11 projecting from the body 10 and an insertion hole into which the axial projection 11 is inserted. The rotation part 316 may be provided behind the front wall 102 of the housing 100. The rotation part 316 may be spaced apart from the first side wall 104*a* of the housing 100, The rotation part 316 may be provided to be closer to the second lever hole 154 than to the first lever hole 150.

The press bar connector 318 may be provided at the front of the rotation part 316 at the first lever 312. The press bar connector 318 may be provided to be closer to the rotation part 316 than to an end portion 3121 of the first lever 312. Accordingly, even when the press bar 332 moves over a small range, the end portion 3121 of the first lever 312 may move over a large range.

The first lever 312 may include a first extension lever 312*a* extending forward from the rotation part 316 and a first bending lever 312*b* being bent from an end portion of the first extension lever 312*a* and forming a curved surface.

When the button 330 is pressed, the first lever 312 passes through the first lever hole 150 of the housing 100 to press the front case 204 of the water tank 200. When the first lever 312 passes through the first lever hole 150 to protrude to the mounting space 100*s*, the water tank 200 may be withdrawn rearward and released.

The second lever 314 may include a second extension lever 314*a* extending rearward from the rotation part 316 and a second bending lever 314*b* bent from an end portion of the second extension lever 314*a* and forming a curved surface.

An extended length of the second lever 314 extending from the rotation part 316 to an end of the second bending lever 314*b* may be shorter than an extended length of the first lever 312 extending from the rotation part 316 to the end portion 3121 of the of the first bending lever 312*b*. A radius of curvature of the curved surface formed by the second bending lever 314*b* may be smaller than a radius of curvature of the curved surface formed by the first bending lever 312*b*.

In the basic arrangement of the lock 300, the second lever 314 may pass through the second lever hole 154 formed at the housing 100 to be inserted into the lever groove 270 of the water tank 200 to fix or lock the arrangement of the water tank 200 mounted in the housing 100.

The lever 310 may include a third or hooking lever 320 protruding from one side of the first lever 312 and connected to the elastic member 334. The hooking lever 320 extends from one side of the first lever 312 in a direction where the button 330 is provided. The elastic member 334, being connected to the hooking lever 320, may apply an elastic force to the first lever 312 in the direction where the button 330 is provided.

The button 330 may be provided on a circumferential surface of the body 10 to as to be accessed from an outside of the body 10. A rear end 330*b* of the button 330 may be rotatably fixed to one side of the body 10. Accordingly, when a user presses the button 330, a front end 330*a* of the button 330 may move to the inside of the body 10 while rotating.

The front end 330*a* of the button 330 may be rotatably connected to the press bar 332. The press bar 332 may be connected to the lever 310 and the button 330 in a link structure. Accordingly, one end of the press bar 332 may be rotatably connected to the button 330, and the other end thereof may be rotatably connected to the lever 310.

When a user presses the button 330, the press bar 332 may press the lever 310 such that one side of the first lever 312 rotates about the rotation part 316 and an end portion of the first lever 312 passes through the first lever hole 150 of the housing 100 to protrude to the mounting space 100*s* of the housing 100. Accordingly, while the water tank 200 is mounted in the housing 100, the first lever 312 presses rearward the front case 204 of the water tank 200 such that the water tank 200 is released and withdrawn rearward from the housing 100.

When the user does not press the button 330, the elastic member 334 pulls the first lever 312 in a direction where the button 330 is provided, such that the second lever 314 passes through the second lever hole 154 to protrude to the mounting space 100*s* of the housing 100. While the water tank 200 is mounted in the housing 100, the second lever 314 is inserted into the lever groove 270 of the water tank 200, such that the water tank 200 may be fixedly provided in the housing 100.

Third Embodiment

Figure 13A:
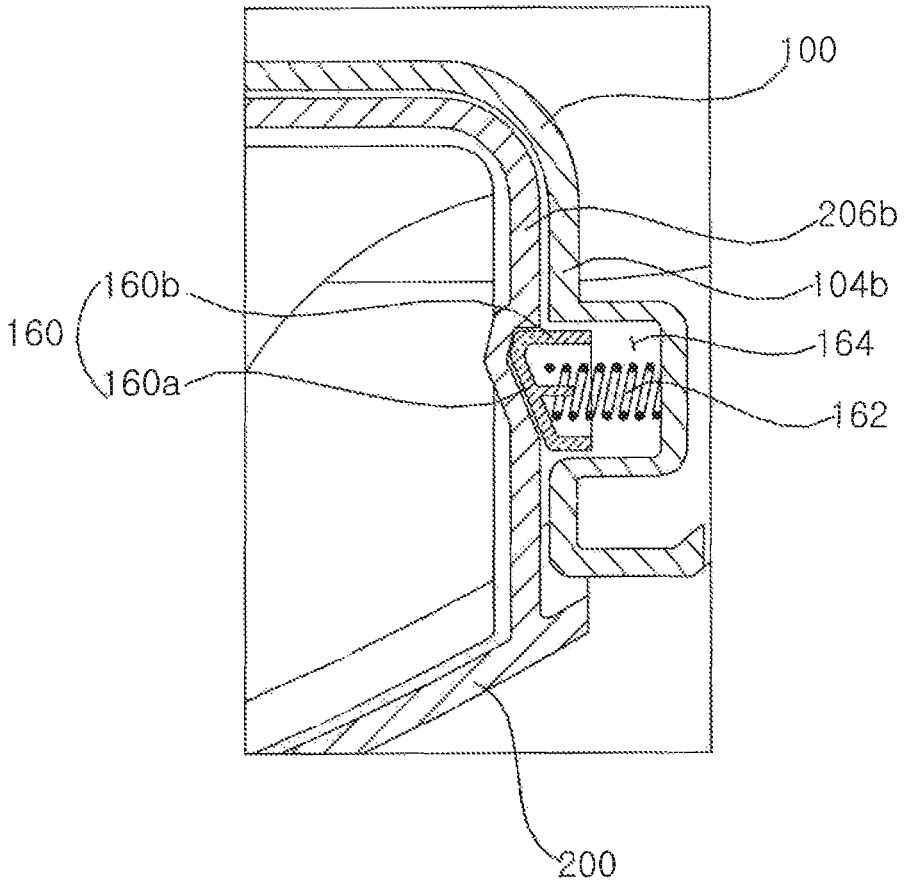
FIG. 13A is a diagram explaining a stopper of a housing, and a state in which a water tank is mounted in the housing by a stopper groove of the water tank, according to yet another embodiment of the present disclosure.
Figure 13B:
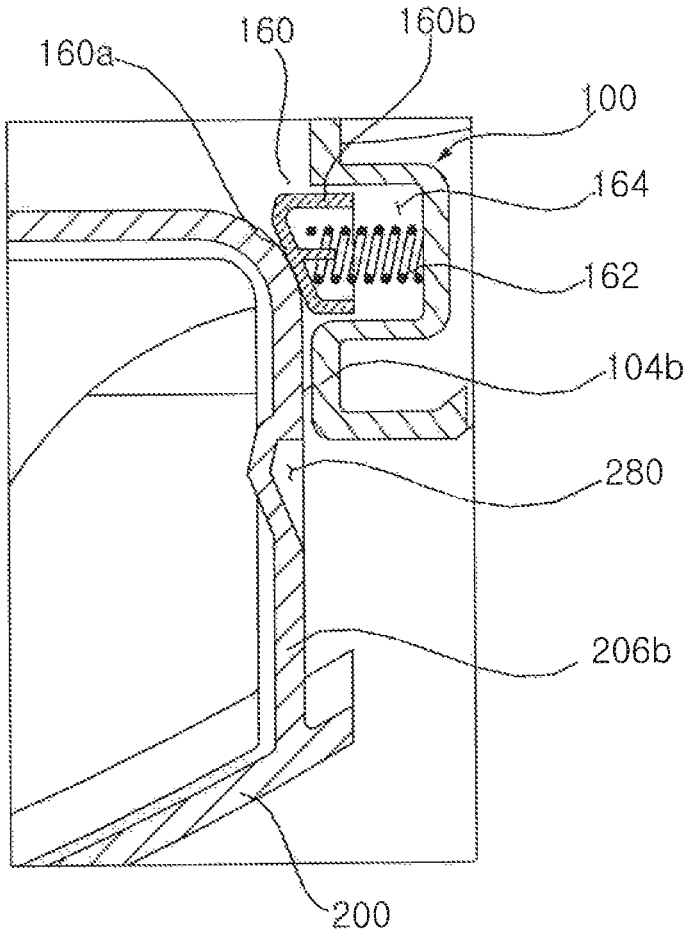
FIG. 13B is a diagram explaining a state in which the water tank is mounted in the housing in the structure of FIG. 13A.

A structure of the housing 100 including the water tank 200 and a stopper 160 according to yet another embodiment of the present disclosure will be described below with reference to FIGS. 13A and 13B. The configuration described in FIGS. 13A and 13B is a configuration arranged on the second side case 206*b* of the water tank 200 and the second side wall 104*b* of the housing 100, and the lock 300 described above with reference to FIGS. 10 to 11B may also be included.

That is, the hinge 272 and the hinge groove 156 described in FIGS. 9 and 12 may be replaced with the stopper 160 and a stopper groove 280 which will be described below with reference to FIGS. 13A and 13B.

The stopper 160 may be provided at the second side wall 104*b* of the housing 100. The stopper 160 may protrude into the mounting space 100*s* by a stopper elastic member or spring 162. When an external pressure or force is applied, the stopper 160 may be inserted into a stopper guide groove 164 formed at the second side wall 104*b*, and the stopper elastic member 162 may be compressed.

The stopper 160 may include an inclined surface or section 160*a* formed to be directed toward the rear side when the stopper 160 protrudes to the mounting space 100*s*, and a hook or side section or surface 160*b* bent from a front end of the inclined surface 160*a* and extending toward the stopper guide groove 164, When no external force is applied, the inclined surface 160*a* and the hook surface 160*b* of the stopper 160 may protrude to the mounting space 100*s*. Accordingly, when the water tank 200 is inserted into the mounting space 100*s*, the water tank 200 comes into contact with the inclined surface 160*a* such that the stopper 160 may move to the stopper guide groove 164. However, once the water tank 200 is mounted in the housing 100, the stopper 160 may be inserted into a stopper groove 280 formed in the second side case 206*b* via an elastic restoring force of the stopper elastic member 162, and the hook surface 160*b* may prevent the water tank 200 from being withdrawn from the housing 100.

The water tank 200 may include the stopper groove 280 into which the stopper 160 is inserted when the water tank 200 is mounted. The stopper groove 280 may have a shape corresponding to the inclined surface 160*a* and the hook surface 160*b* of the stopper 160 and be configured to surround or contact at least a portion of the hook surface 160*b* such that a rearward direction of the water tank 200 may be prevented.

Figure 11B:
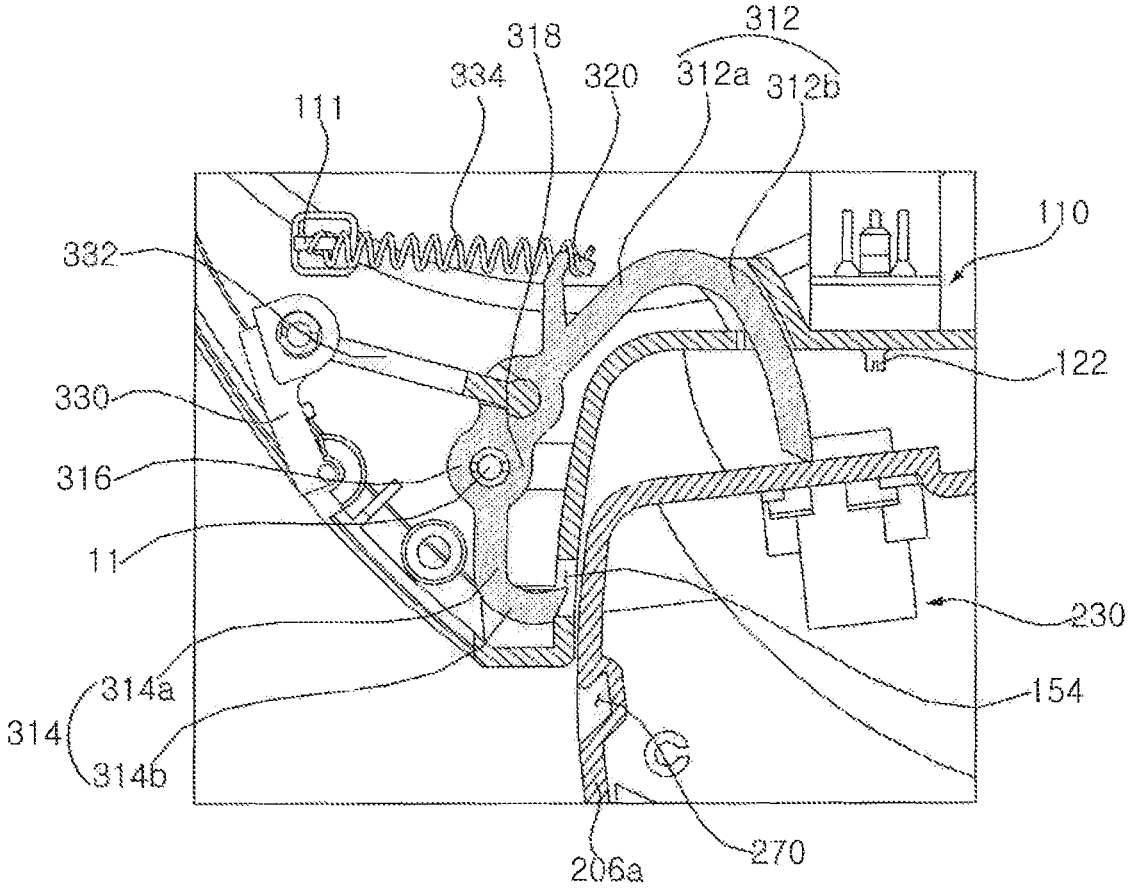
FIG. 11B is a diagram explaining a state in which a water tank is withdrawn outside of a housing by a lock, according to another embodiment of the present disclosure.

The stopper 160 may be adjacent to the rear end of the second side case 206*b*, and a connection portion between the inclined surface 160*a* and the hook surface 160*b* may be formed in a curved shape such that, when one side of the water tank 200 is pushed rearward by the lock 300 of FIGS. 10 to 11B, the water tank 200 may be withdrawn by rotating about the stopper 160 as an axis.

This application is related to U.S. Application Ser. No. 16/944,355 filed on Jul. 31, 2020 and Ser. No. 16/944,375 filed on Jul. 31, 2020, the entire disclosures of which are incorporated by reference herein.

Embodiments disclosed herein may provide a robot cleaner in which a water tank is detachably mounted therein and fixed stably. The robot cleaner may minimize water leakage occurring at a portion where the detachably mounted water tank is connected. The robot cleaner may allows a user to easily withdraw the water tank mounted in the robot cleaner.

The objects of the present disclosure are not limited to the aforementioned objects and other objects not described herein will be clearly understood by those skilled in the art from the following description.

Embodiments disclosed herein may be implemented as a robot cleaner including a water tank forming a space for storing water, a body forming an exterior and having a housing or recess which forms a space in which the water tank is mounted, a pair of spin mops rotatably mounted at a lower side of the body and adapted to move the body by rotating and to mop a surface to be cleaned, a first nozzle, provided at one side of the housing, and when connected to the water tank, supplying the water stored in the water tank to each of the pair of spin mops, a second nozzle provided at one side of the water tank, and when the water tank is mounted in the housing, connected to the first nozzle to communicate the water tank with the first nozzle, and a fixing part.

The fixing part may generate a magnetic force when the water tank is mounted in the housing to fix an arrangement of the water tank mounted in the housing, thereby fixing the water tank mounted in the housing. In addition, the fixing part may include a fixing device provided around a circumference of the second nozzle and a response fixing device provided around a circumference of the first nozzle and having a shape corresponding to the fixing device. The first nozzle and the second nozzle may be attached to each other by the fixing device and the response fixing device such that a connection portion between the housing and the water tank, through which water flows, and may attached.

The fixing device may have a ring shape around the circumference of the second nozzle, and the response fixing device may have a shape corresponding to the fixing device and may be provided around the circumference of the first nozzle, thereby allowing the first nozzle and the second nozzle to be attached to each other. At least one of the fixing device and the response fixing device uses a magnet generating a magnetic force to form an attractive force therebetween, thereby increasing the attractive force generated therebetween.

The second nozzle may be spaced apart from a center of the water tank in either a left direction or a right direction, and the first nozzle may be provided at a position corresponding to the second nozzle, thereby fixing the water tank and the housing in a left-right direction with respect to the center thereof.

The fixing device may include a first fixing device being provided around the circumference of the second nozzle and a second fixing device being spaced apart from the center of the water tank in an opposite direction to the first fixing device. The response fixing device may include a first response fixing device provided around the circumference of the first nozzle and a second response fixing device provided at a position corresponding to the fixing device.

The second nozzle may include an insertion having an opening being open toward a front and protruding forward from a front surface of the water tank, a valve provided at a rear side of the insertion or insertion nozzle and adapted to open and close the opening by moving forward and backward, and a nozzle housing forming a space in which the valve is disposed and being mounted on an inside of the water tank.

An inner sealer and an outside sealer may be provided between the water tank and the nozzle housing, the inner sealer being provided around a portion where the opening is formed and the outside sealer being provided along an outer circumference of the nozzle housing. The fixing part may be provided between the inner sealer and the outside sealer, thereby preventing water from flowing into the fixing part.

The fixing device may include a first fixing device provided between the nozzle housing and the water tank and a second fixing device being spaced apart from the center of the water tank in an opposite direction to the first fixing device. A fixing device housing to fix the second fixing device to the water tank may be provided at the water tank, and a sealer to prevent water from flowing into the second fixing device may be provided between the fixing device housing and the water tank, thereby preventing water from flowing into the second fixing device.

The first nozzle may include an insertion portion being formed at one side of the housing and forming an insertion space into which the second nozzle is inserted, a press protruding in a direction in which the water tank is provided, and when the water tank is mounted in the housing, pressing the valve to open the opening, and a sealer provided in the insertion space and attached to the insertion which is inserted into an insertion groove.

The sealer may include a sealer end provided at an inner end portion of the insertion portion and coming into contact with an end portion of the second nozzle inserted into the insertion space, a sealer circumference being connected to the sealer end and extending along a circumferential surface of the press, and at least one sealer projection projecting from the sealer circumference toward the insertion space. Specifically, the sealer projection may include a first sealer projection provided at an end portion of the sealer circumference and a second sealer projection provided between the first sealer projection and the sealer end, thereby preventing water from leaking to the outside.

A handle may be provided at a lower surface of the water tank. The handle may have a groove so that the water tank may be withdrawn from the housing, thereby allowing a user to easily withdraw the water tank.

The robot cleaner may further include a lock provided on an inside of the body, rotatably provided at a position spaced apart from a circumferential surface of the housing, and fixing the arrangement of the water tank mounted in the housing or pushing the water tank to a rear side, thereby allowing a user to easily withdraw the water tank. The lock may include a lever and a button. The lever may rotate about a rotary shaft formed at a position spaced apart from an outer side of the circumferential surface of the housing and be inserted into a lever groove formed at a side surface of the water tank or press a front surface of the water tank. The button may be provided on the circumferential surface of the body and be connected to the lever. When a force is applied by a user to the button, the lever may press the front surface of the water tank, thereby allowing the water tank to be withdrawn.

The lock may include a press bar to transmit a force, exerted on the button, to the lever, and an elastic part to maintain a basic arrangement of the lever such that the force exerted on the button may be transmitted to the lever. When no external force is applied, the basic arrangement may be maintained by the elastic part.

The lever may include a rotation part rotatably coupled to the body, a press bar connector connected to the press bar, a first lever, and a second lever. The first lever may protrude forward from the rotation part, be bent toward a front wall of the housing, and press the front surface of the water tank mounted in the housing. The second lever may protrude rearward from the rotation part and be bent toward a second lever hole formed at a side wall of the housing.

In the basic arrangement of the lock, the second lever may be inserted into the lever groove of the water tank mounted in the housing. When pressure is applied to the button, the second lever may be withdrawn from the lever groove, and the first lever presses the water tank to a rear side of the housing such that a user may easily withdraw the water tank. When the water tank is mounted in the housing, the water tank may be fixed stably.

The water tank may include a hinge protruding forward in a convex curved shape from a side surface opposite to the one side surface of the water tank on which the lever groove is formed. A hinge groove into which the hinge of the water tank is inserted may be formed at the housing such that the hinge may fix the water tank or, when the water tank is withdrawn by the lock, the hinge may function as a hinge axis.

The housing may have a stopper provided on a side surface opposite to one side surface of the housing on which the second lever hole is formed. The stopper may protrude into the mounting space by a stopper elastic part. The water tank may have a stopper groove into which the stopper is inserted when the water tank is mounted in the housing so as to fix the arrangement of the water tank, thereby fixing the other side of the water tank.

According to the present disclosure, the robot cleaner has one or more of the following effects.

Firstly, a fixing device and a response fixing device may be provided at a water tank and a housing, respectively, such that the water tank may be mounted stably in the housing. Particularly, in the case where a magnet is used as the response fixing device and the fixing device, a strong attractive force is generated therebetween, such that the water tank may be fixed stably.

Secondly, each of the response fixing device and the fixing device may be arranged in a ring shape around a circumference of a first nozzle and a second nozzle being provided for the flow of water, and the response fixing device and the fixing device may be firmly attached to each other specifically at a portion through which water flows, thereby preventing water leakage, and enabling smooth supply of water to spin mops.

Thirdly, a sealer may be provided at a portion where the fixing part is provided to prevent water from flowing to the magnet such that a magnetic force, generated by the magnet, may be maintained for an extended period of time, thereby securing a long service life of the magnet.

Fourthly, a handle to withdraw the water tank from the housing, a lock, and the like are provided for the robot cleaner, thereby allowing a user to easily draw out the water tank and provide convenience in using the water tank.

Embodiments disclosed herein may be implemented as a robot cleaner comprising a tank configured to store liquid, a body having a dock to which the tank may be mounted, a spin mop provided below the body and configured to receive the liquid, a first nozzle protruding from the dock, a second nozzle protruding from the tank and positioned so as to couple with the first nozzle when the tank is mounted to the dock such that, when the tank is mounted, liquid from the tank flows to the spin mop via the first and second nozzles, and a first magnetic coupler to magnetically couple the tank to the dock. The first magnetic coupler may include a first metal and a second metal configured to be magnetically attracted to the first metal. At least one of the first or second metals may be a magnet.

The first metal may have a ring shape provided around a circumference of the first nozzle, and the second metal may have a ring shape corresponding to the ring shape of the first metal and provided around a circumference of the second nozzle.

The second nozzle may be spaced apart from a left-right center of the tank in a first direction, and the first nozzle may be provided at a position corresponding to the second nozzle so as to align with the second nozzle when the tank may be mounted in the dock.

A second magnetic coupler may comprise a third metal coupled to the tank and spaced apart from the left-right center of the tank in a second direction opposite to the first direction, and a fourth metal coupled to the dock at a position corresponding to the third metal such that the third and fourth metals are aligned when the tank is mounted in the dock. The third and fourth metals may be configured to be magnetically coupled to each other.

The dock may be provided at a rear of the body. The second nozzle may include an insertion protrusion having an opening extending in a front-rear direction, the insertion protrusion protruding from a front of the tank, a valve provided at a rear of the insertion protrusion and configured to open or close the opening, and a nozzle housing mounted on an inside of the tank and having a space in which the valve may be provided.

An inner seal may be provided around a portion where the opening may be formed, and an outer seal may be provided between an inner surface of the tank and the nozzle housing to surround an outer circumference of the nozzle housing. The second metal may be provided between the inner seal and the outer seal.

A second magnetic coupler may have a third metal coupled to the tank and a fourth metal coupled to the dock and configured to be magnetically attracted to the third metal. At least one of the third or fourth metals may be a magnet.

A coupler housing may be provided inside of the tank to house the third metal. The first magnetic coupler may be spaced apart from a center of the tank in a first direction when the tank is mounted, and the second magnetic coupler may be spaced apart from the center of the tank in a second direction opposite to the first direction.

A coupler sealer may prevent liquid from flowing into the coupler housing. Both of the first and second metals may be magnets having opposite polarities, and both of the second and third metals may be magnets having opposite polarities.

The first nozzle may include an insertion protrusion formed at a front of the dock and forming an insertion space into which the second nozzle may be inserted, press protrusion protruding rearward such that, when the tank is mounted to the dock, the press protrusion presses the valve to open the opening, and a nozzle seal provided in the insertion space and attached to an outer surface of the press protrusion.

The nozzle seal may include a front end portion provided around a front of the press protrusion and configured to contact an end portion of the second nozzle when the second nozzle may be fully inserted into the insertion space, a circumferential surface extending along a circumferential surface of the press, and at least one fin projecting outward from the circumferential surface into the insertion space.

The at least one fin may comprise a first fin provided at a rear end portion of the circumferential surface and a second fin provided between the first fin and the front end portion.

A handle having a groove may be provided at a lower surface of the tank. The dock may have a lower opening such that the groove of the handle may be exposed when the tank is mounted to the dock to allow the tank to be withdrawn from the dock via the groove the handle.

A lock may be provided inside of the body and configured to rotate such that, when the lock is rotated in a first direction, a first section of the lock may protrude into the dock to couple to the tank and secure the tank to the dock, and when the lock is rotated in a second direction opposite to the first direction, a second section of the lock may protrude into the dock to push the tank away from the dock to release the tank from the dock.

The lock may comprise a lever groove formed at a first side of the tank, a lever rotating about a rotary shaft formed at a position spaced apart from a wall of the dock, the lever having the first and second sections, the first section being configured to be inserted into the lever groove and the second section being configured to press a front of the tank, and a button provided on the body to be exposed to an outside of the body, the button being connected to the lever. When a force is applied to the button, the second section of the lever may press the front of the tank.

The lock may comprise a press bar to transmit a force exerted on the button to the lever, and an elastic member to maintain a basic arrangement of the lever.

The lever may comprise a fulcrum rotatably coupled to the body, a press bar connector connected to the press bar, a first lever hole formed through a first side of the dock, a first lever having the first section, the first lever protruding rearward from the fulcrum and curved toward the first lever hole, and a second lever having the second section, the second lever protruding forward from the fulcrum and curved toward a front of the dock.

Only one of the first and second levers may contact the tank at time such that in a first state of the lock, the first lever may be inserted into the lever groove of the tank mounted in the dock, and when pressure is applied to the button, the first lever may be withdrawn from the lever groove, and the second lever may press a front of the tank away from the dock.

The tank may include a hinge having a convex curvature and provided at a second side surface to the first side having the lever groove, and the dock may include a hinge groove into which the hinge of the tank may be inserted.

The dock may have a stopper provided on a second side opposite to the first side having the first lever hole, the stopper protruding into the dock via a stopper elastic member, and the tank may have a stopper groove into which the stopper may be inserted when the tank is mounted in the dock so as to secure a mounting of the tank.

Embodiments disclosed herein may be implemented as a robot cleaner comprising a body having a first nozzle, a spin mop provided below the body, a tank configured to be coupled to and removed from a side of the body and configured to store liquid for the spin mop, the tank having a second nozzle configured to couple to the first nozzle, and a magnetic coupler configured to couple the tank to the body via a magnetic force, the magnetic coupler surrounding at least one of the first nozzle or the second nozzle.

However, the effects of the present disclosure are not limited to the aforesaid, and other effects not described herein will be clearly understood by those skilled in the art from the following description of the appended claims.

While the present disclosure has been shown and described with reference to the preferred embodiments thereof, it should be understood that the present disclosure is not limited to the aforementioned specific embodiments, and various modifications and variations may be made by those skilled in the art without departing from the scope and spirit of the invention as defined by the appended claims, and the modified implementations should not be construed independently of the technical idea or prospect of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A robot cleaner, comprising:
- a tank configured to store liquid;
- a body having a dock to which the tank is mounted;
- a spin mop provided below the body and configured to receive the liquid;
- a first nozzle protruding from the dock;
- a second nozzle protruding from the tank and positioned so as to couple with the first nozzle when the tank is mounted to the dock such that, when the tank is mounted, liquid from the tank flows to the spin mop via the first and second nozzles; and
- a first magnetic coupler to magnetically couple the tank to the dock, comprising:
  - a first metal; and
  - a second metal configured to be magnetically attracted to the first metal,
- wherein the second nozzle is formed to protrude in a direction in which the tank is inserted into the dock,
- wherein the first metal has a ring shape provided around a circumference of the first nozzle, and the second metal has a ring shape corresponding to the ring shape of the first metal and provided around a circumference of the second nozzle,
- wherein the dock is provided at a rear of the body, and the second nozzle includes:
  - an insertion protrusion having an opening extending in a front-rear direction, the insertion protrusion protruding from a front of the tank;
  - a valve provided at a rear of the insertion protrusion and configured to open or close the opening; and
  - a nozzle housing mounted on an inside of the tank and having a space in which the valve is provided,
- wherein the robot cleaner further comprises:
  - an inner seal provided around a portion where the opening s formed; and
  - an outer seal provided between an inner surface of the tank and the nozzle housing to surround an outer circumference of the nozzle housing, and
- wherein the second metal is provided between the inner seal and the outer seal.

2. The robot cleaner of claim 1, wherein the second nozzle is spaced apart from a left-right center of the tank in a first direction, and the first nozzle is provided at a position corresponding to the second nozzle so as to align with the second nozzle when the tank is mounted in the dock.

3. The robot cleaner of claim 2, further comprising a second magnetic coupler, comprising:
- a third metal coupled to the tank and spaced apart from the left-right center of the tank in a second direction opposite to the first direction; and
- a fourth metal coupled to the dock at a position corresponding to the third metal such that the third and fourth metals are aligned when the tank is mounted in the dock, wherein the third and fourth metals are configured to be magnetically coupled to each other.

4. The robot cleaner of claim 1, further comprising:
- a second magnetic coupler having a third metal coupled to the tank and a fourth metal coupled to the dock and configured to be magnetically attracted to the third metal; and
- a coupler housing provided inside of the tank to house the third metal, wherein the first magnetic coupler is spaced apart from a center of the tank in a first direction when the tank is mounted, and the second magnetic coupler is spaced apart from the center of the tank in a second direction opposite to the first direction.

5. The robot cleaner of claim 4, further comprising a coupler sealer to prevent liquid from flowing into the coupler housing, wherein the first and second metals are magnets having opposite polarities, and the second and third metals are magnets having opposite polarities.

6. The robot cleaner of claim 1, wherein the first nozzle comprises:

an insertion protrusion formed at a front of the dock and forming an insertion space into which the second nozzle is inserted;

a press protrusion protruding rearward such that, when the tank is mounted to the dock, the press protrusion presses the valve to open the opening; and a nozzle seal provided in the insertion space and attached to an outer surface of the press protrusion.

7. The robot cleaner of claim 6, wherein the nozzle seal comprises:

a front end portion provided around a front of the press protrusion and configured to contact an end portion of the second nozzle when the second nozzle is fully inserted into the insertion space;

a circumferential surface extending along a circumferential surface of the press protrusion; and at least one fin projecting outward from the circumferential surface of the nozzle seal into the insertion space.

8. The robot cleaner of claim 7, wherein the at least one fin comprises a first fin provided at a rear end portion of the circumferential surface of the nozzle seal and a second fin provided between the first fin and the front end portion.

9. The robot cleaner of claim 1, wherein a handle having a groove is provided at a lower surface of the tank, and the dock has a lower opening such that the groove of the handle is exposed when the tank is mounted to the dock to allow the tank to be withdrawn from the dock via the groove the handle.

* * * * *